US007008192B2

(12) United States Patent
Hidalgo

(10) Patent No.: US 7,008,192 B2
(45) Date of Patent: Mar. 7, 2006

(54) CEILING FAN BLADE ATTACHMENT ASSEMBLY

(75) Inventor: Rolando Hidalgo, Orange, CA (US)

(73) Assignee: Minka Lighting, Inc., Corona, CA (US)

( * ) Notice: Subject to any disclaimer, the term of this patent is extended or adjusted under 35 U.S.C. 154(b) by 0 days.

(21) Appl. No.: 10/154,125

(22) Filed: May 23, 2002

(65) Prior Publication Data

US 2003/0219340 A1 Nov. 27, 2003

(51) Int. Cl.
*F04D 29/34* (2006.01)

(52) U.S. Cl. ..... 416/206; 416/220 A

(58) Field of Classification Search ..... 416/5, 416/204 R, 205, 207, 210 R, 219 R, 220 R, 416/221, 220 A
See application file for complete search history.

(56) References Cited

U.S. PATENT DOCUMENTS

| | | | | |
|---|---|---|---|---|
| 2,237,039 A | | 4/1941 | Newnham | 170/173 |
| 5,421,701 A | | 6/1995 | Funston | 415/5 |
| 5,433,585 A | | 7/1995 | Yan | 416/204 R |
| 5,462,412 A | | 10/1995 | Scofield et al. | 416/210 R |
| 5,681,147 A | * | 10/1997 | Yung-Chung | 416/5 |
| 5,944,486 A | * | 8/1999 | Hodgkins, Jr. | 416/210 R |
| 5,951,253 A | | 9/1999 | Gajewski | 416/214 R |
| 5,980,353 A | * | 11/1999 | Wu | 416/210 R |
| 6,010,306 A | * | 1/2000 | Bucher et al. | 416/210 R |
| 6,059,531 A | * | 5/2000 | Tai | 416/210 R |
| 6,158,964 A | | 12/2000 | Gajewski | 416/244 R |
| 6,250,885 B1 | | 6/2001 | Gajewski | 416/214 R |
| 6,261,064 B1 | | 7/2001 | Tang | 416/210 R |
| D448,840 S | | 10/2001 | Gajewski | D23/377 |
| 6,336,792 B1 | | 1/2002 | Bucher et al. | 416/210 R |
| 6,354,801 B1 | | 3/2002 | Gajewski | 416/5 |
| 6,357,714 B1 | | 3/2002 | Johnson | 248/343 |
| 6,364,617 B1 | | 4/2002 | Riske et al. | 416/246 |
| 6,364,638 B1 | | 4/2002 | Liu | 417/423.15 |
| 6,371,729 B1 | | 4/2002 | Tseng | 416/210 R |
| 6,378,824 B1 | * | 4/2002 | Tseng | 416/210 R |

FOREIGN PATENT DOCUMENTS

JP 57102599 A * 6/1982

OTHER PUBLICATIONS

U.S. Appl. No. 29/135,461, filed Jan. 10, 2001, Gajewski.
U.S. Appl. No. 29/160,669, filed May 14, 2002, Hidalgo.
U.S. Appl. No. 29/160,662, filed May 14, 2002, Hidalgo.
U.S. Appl. No. 29/160,663, filed May 14, 2002, Hidalgo.
U.S. Appl. No. 29/160,664, filed May 14, 2002, Hidalgo.
U.S. Appl. No. 29/160,737, filed May 14, 2002, Hidalgo.
Minka Lighting, Inc.; MinkaAire; 1997 (estimated date of publication); pp. 6,7; Minka Lighting, Inc.; U.S.A.
Minka Lighting, Inc.; MinkaAire Two Thousand One; Oct. 5, 2000; pp. 8,9; Minka Lighting, Inc.; U.S.A.
Minka Lighting, Inc.; MinkaAire Two Thousand Two; Apr. 22, 2002; pp. 14,15; Minka Lighting, Inc.; U.S.A.

* cited by examiner

*Primary Examiner*—Thomas E. Lazo
*Assistant Examiner*—Richard A. Edgar
(74) *Attorney, Agent, or Firm*—Baker & McKenzie LLP

(57) ABSTRACT

A fan comprising one or more releasable fan blades secured to a hub portion. A spring biased pin may be mounted in a motor housing to automatically secure a fan blade when it is connected with a motor body.

40 Claims, 4 Drawing Sheets

CEILING FAN BLADE ATTACHMENT ASSEMBLY

FIELD OF THE INVENTION

The field of the present invention relates to fans, and in particular ceiling fans.

BACKGROUND OF THE INVENTION

A typical ceiling fan will include a down rod assembly suspended from the ceiling with a motor shaft connected to a lower portion of the down rod assembly. A motor body rotates about the motor shaft. A motor housing that surrounds the motor may be secured to either the motor shaft or the down rod assembly, which is stationary. Blade mounting arms are connected to the motor body and extend out of an opening of the motor housing or below the motor housing. A hub is attached to the motor shaft below the fan blades and fan blade arms. U.S. Pat. Nos. 6,250,885 and 6,354,801, issued to Gajewski and commonly assigned with this invention, are incorporated herein by reference in their entirety.

The motor housing in a typical ceiling encloses the motor. And typical ceiling fans require three or more screws connecting each fan blade to a blade arm. Thus, assembly of the ceiling fan is cumbersome and time consuming. The greater the number of blades the longer the assembly time. And the screws may become loosened from vibration of running the fan. Additionally, there are a variety of reasons for removing fan blades from a fan hub portion, including bringing the hub portion in for repair or replacing broken fan blades or for cleaning. Thus, there has been a need for easy installation and replacement of fan blades. Prior art attempts have not proved to be entirely successful.

OBJECTS OF THE INVENTION

It is an object of the invention to provide a fan that is easy to assembly. Another object is to provide a fan that is easy to disassemble.

An object of the invention is to provide a fan that, in at least one embodiment comprises a housing, wherein at least a portion of the housing rotates with the fan blades. A further objective is to provide for inserting blades into the housing. An alternate objective is to provide a housing that does not rotate with the blades. A further objective is to rotate the blades beneath a motor housing.

An object of the invention is to provide means for attaching the blades to one or both of the motor housing or the motor. A further objective is to position, at least a portion of, the attachment means in the housing. Yet a further objective is to attach the blades, at least in part, with a releasable engagement.

Another object of the invention is to position the releasable engagement in the housing while providing for easy assembly of the fan. A further objective is to also provide for easy disassembly of the fan although the releasable engagement is positioned in the housing.

Yet another object of the invention is to provide a fan kit comprising easy assembly components. A further objective is to provide replacement components that may be easily assembled with original components or other replacement components.

Yet a further objective is to provide a fan that may be customized by a user. The user may, for example, want to update selected components of the fan to match a new room décor without having to purchase an entirely new fan.

Other objects and advantages of the invention will be apparent to those of skill in the art.

SUMMARY OF THE INVENTION

A ceiling fan comprising a motor having a motor shaft connected to a down rod assembly and a motor body which rotates about the motor shaft. The phrases motor body and motor shaft are intended to be broadly construed, unless indicated otherwise, such that the motor shaft is a stationary component of the motor and the motor body is a component of the motor that rotates relative the motor shaft. In one embodiment, a blade mounting arm comprising a sleeve is connected to the motor body. A fan blade is positioned in the sleeve. And a releasable engagement secures the blade in the sleeve.

The fan may comprise a motor housing rotatable with and connected to the motor body, wherein the motor housing comprises a slot. The fan blade is inserted into the slot. The releasable engagement is preferably positioned in the motor housing to automatically engage the fan blade when the fan blade is properly positioned to the slot. The fan blade is thus secured to a hub portion of the fan. The hub portion should be construed broadly to mean the general central portion of the fan. And the phrase hub portion is not intended to require that it include the stationary hub.

Accordingly, one method of installing the fan blade comprises aligning the fan blade with the sleeve connected to the motor body and inserting the fan blade into the sleeve. The fan blade is positioned into the sleeve to allow a releasable engagement to automatically secure the fan blade in the sleeve when the fan blade is properly positioned in the sleeve.

Removal of the fan blade is conveniently achieved with use of the releasable engagement. A method of removing a fan blade comprises locating the releasable engagement that is securing the fan blade in position and applying a force to release the releasable engagement. Then the fan blade is withdrawn from the hub portion of the fan.

In a preferred embodiment, a catch on the releasable engagement is pulled by inserting a tool into the housing. In some embodiments the tool is inserted into the motor housing to catch a catch of the releasable engagement and pull it, thus releasing the releasable engagement.

For some applications, the invention encompasses a kit where fan components are, adapted to be connected via, for example, releasable engagement. For example, a kit comprising fan blades comprising a releasable engagement where the fan blades are adapted to interact with a hub portion of a ceiling fan. Alternatively, a central hub portion comprising a releasable engagement is adapted to interact with one or more fan blades adapted to interact with the releasable engagement.

Other aspects of the present invention will become apparent to those skilled in the art upon studying this disclosure.

DETAILED DESCRIPTION OF THE ILLUSTRATED EMBODIMENT

Figure 1:
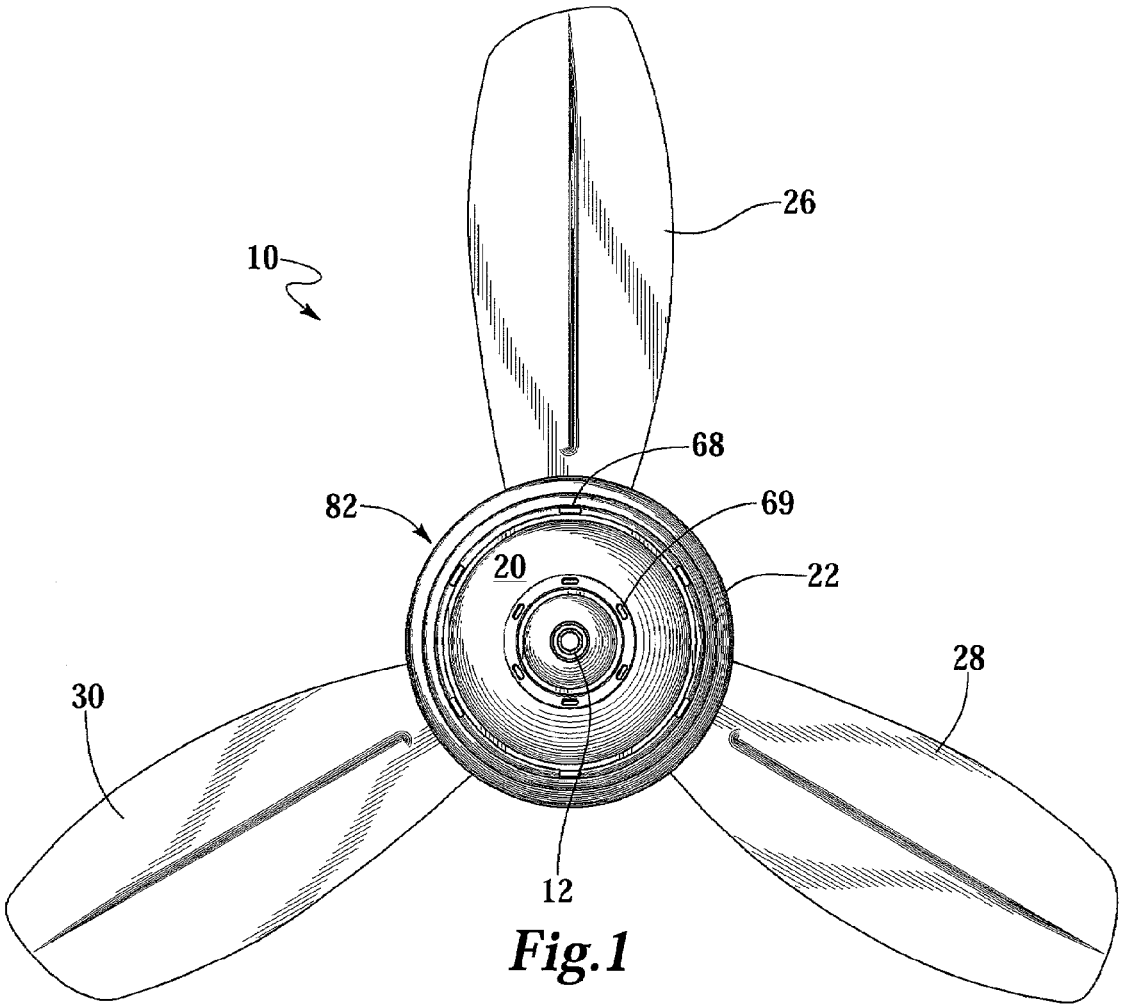
FIG. 1 depicts a plain view of a ceiling fan with a hub portion, centrally located, and with fan blades.
Figure 2:
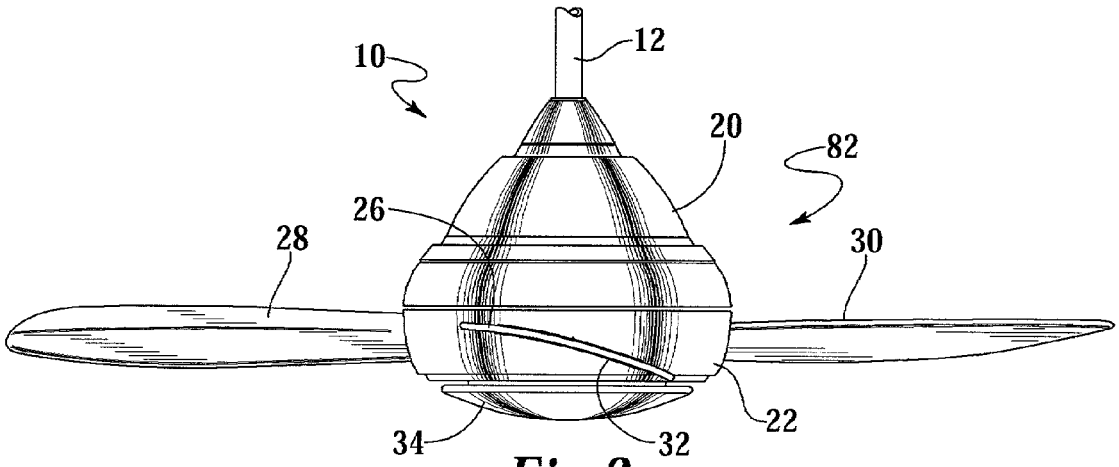
FIG. 2 depicts an elevation view of a ceiling fan showing in a motor housing for receiving a fan blade.
Figure 3:
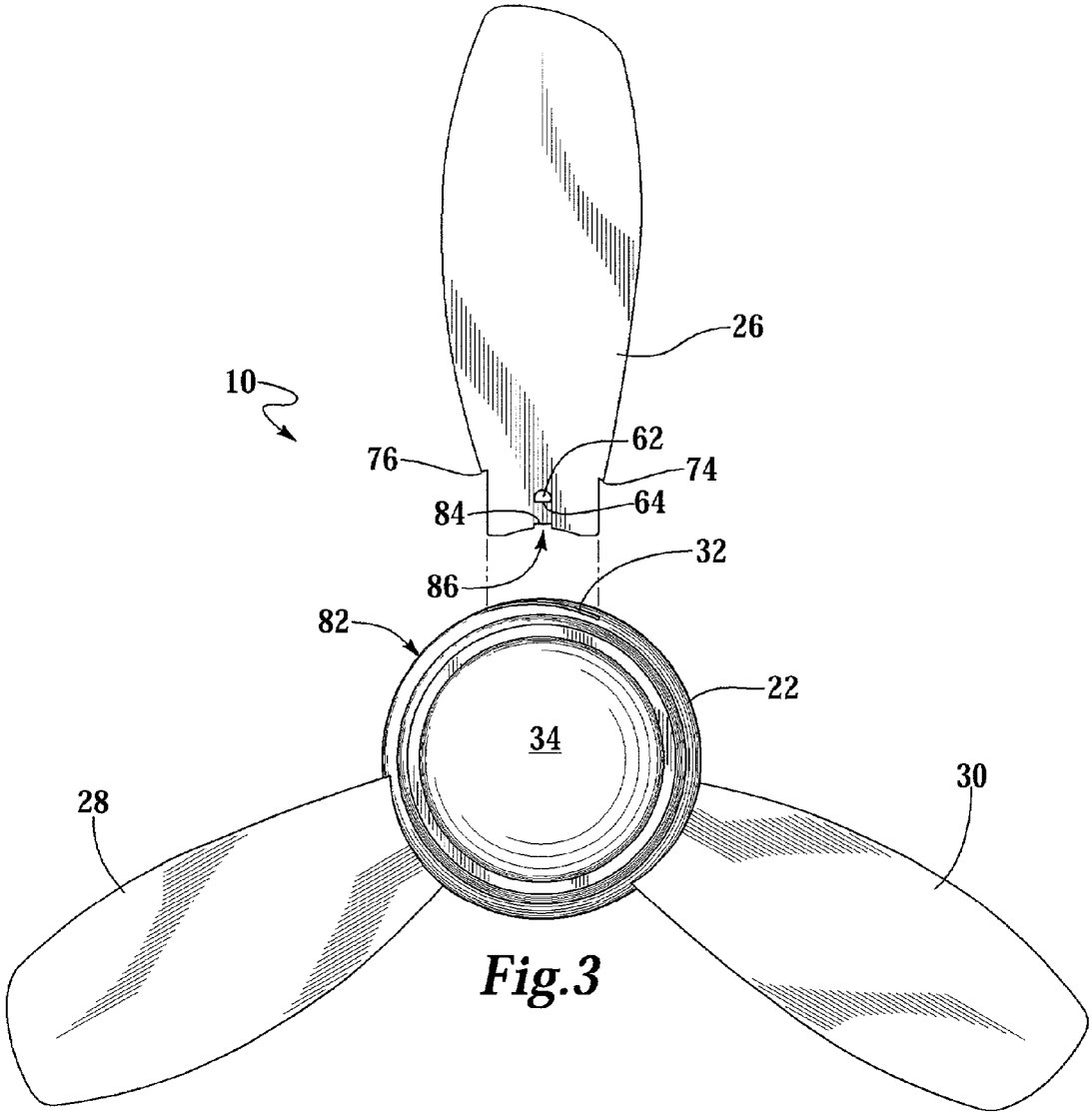
FIG. 3 depicts a bottom view of a ceiling fan with a fan blade removed from the hub portion and aligned with a slot in the motor housing.
Figure 4:
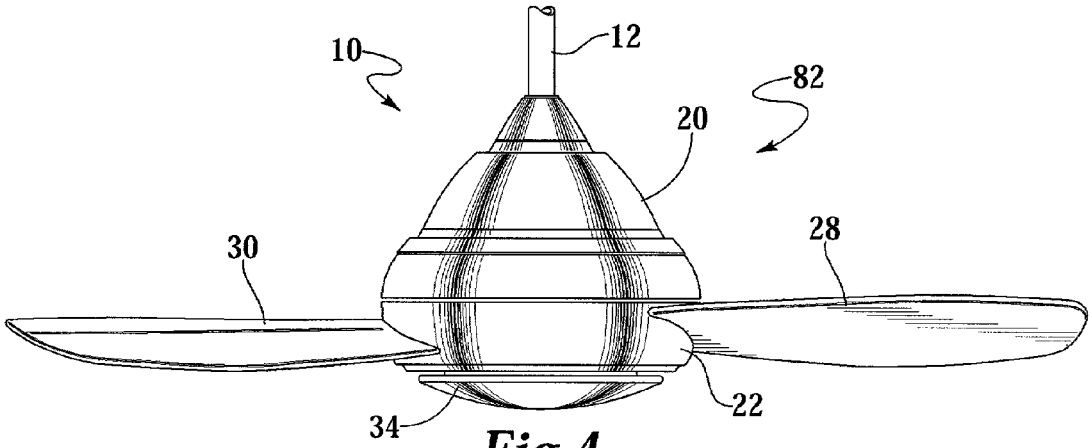
FIG. 4 depicts an elevation view of the fan shown in FIG. 2, but viewed from the opposite direction.
Figure 5:
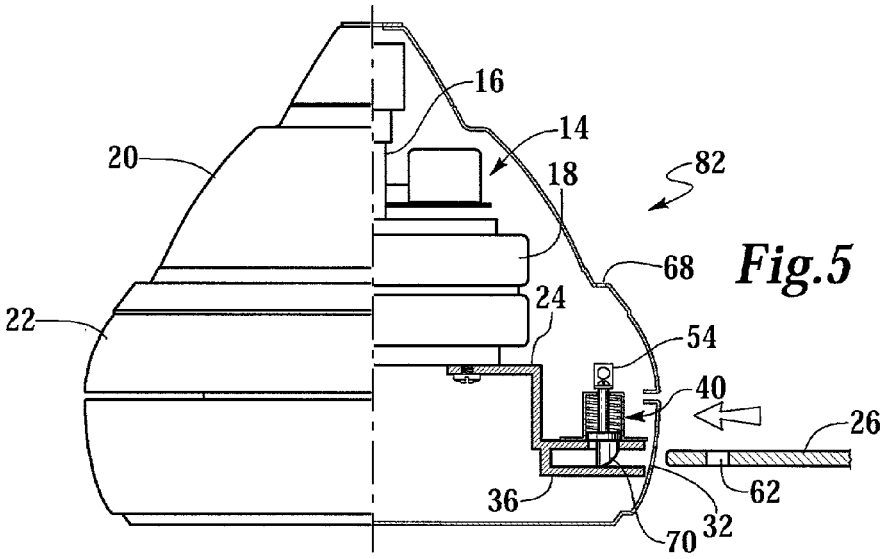
FIG. 5 depicts a view showing part of the interior of the hub portion, to expose a motor body, with the fan blade being inserted into the hub portion.
Figure 6:
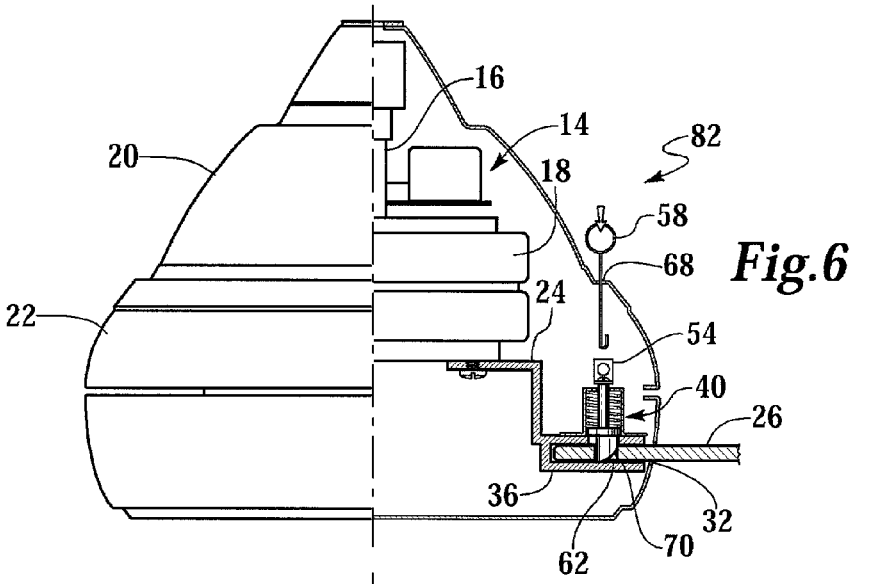
FIG. 6 depicts an elevation view of a ceiling fan showing part of the interior and a tool positioned over a releasable engagement and being inserted into the motor housing.
Figure 7:
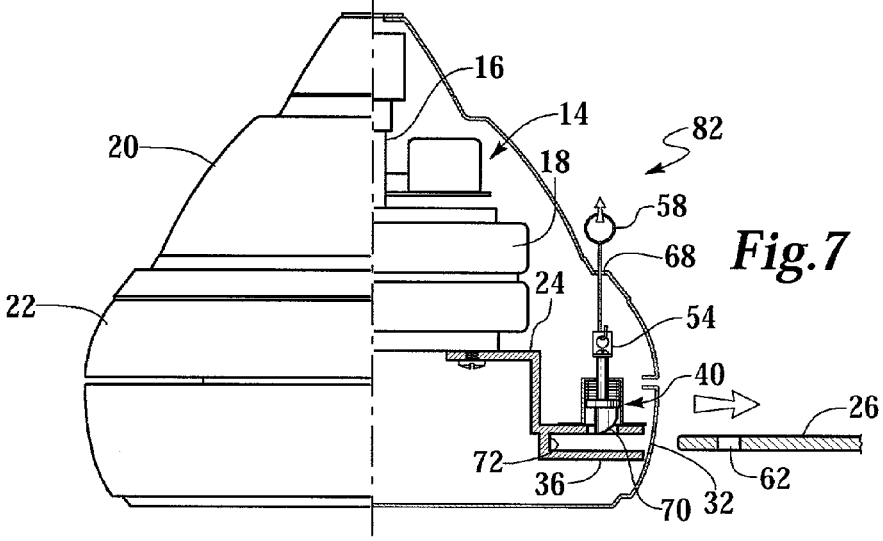
FIG. 7 depicts a view showing part of the interior of the hub portion with the tool engaging the releasable engagement and applying a force to a pin of the releasable engagement. Release of the pin allows the fan blade to be withdrawn.
Figure 8:
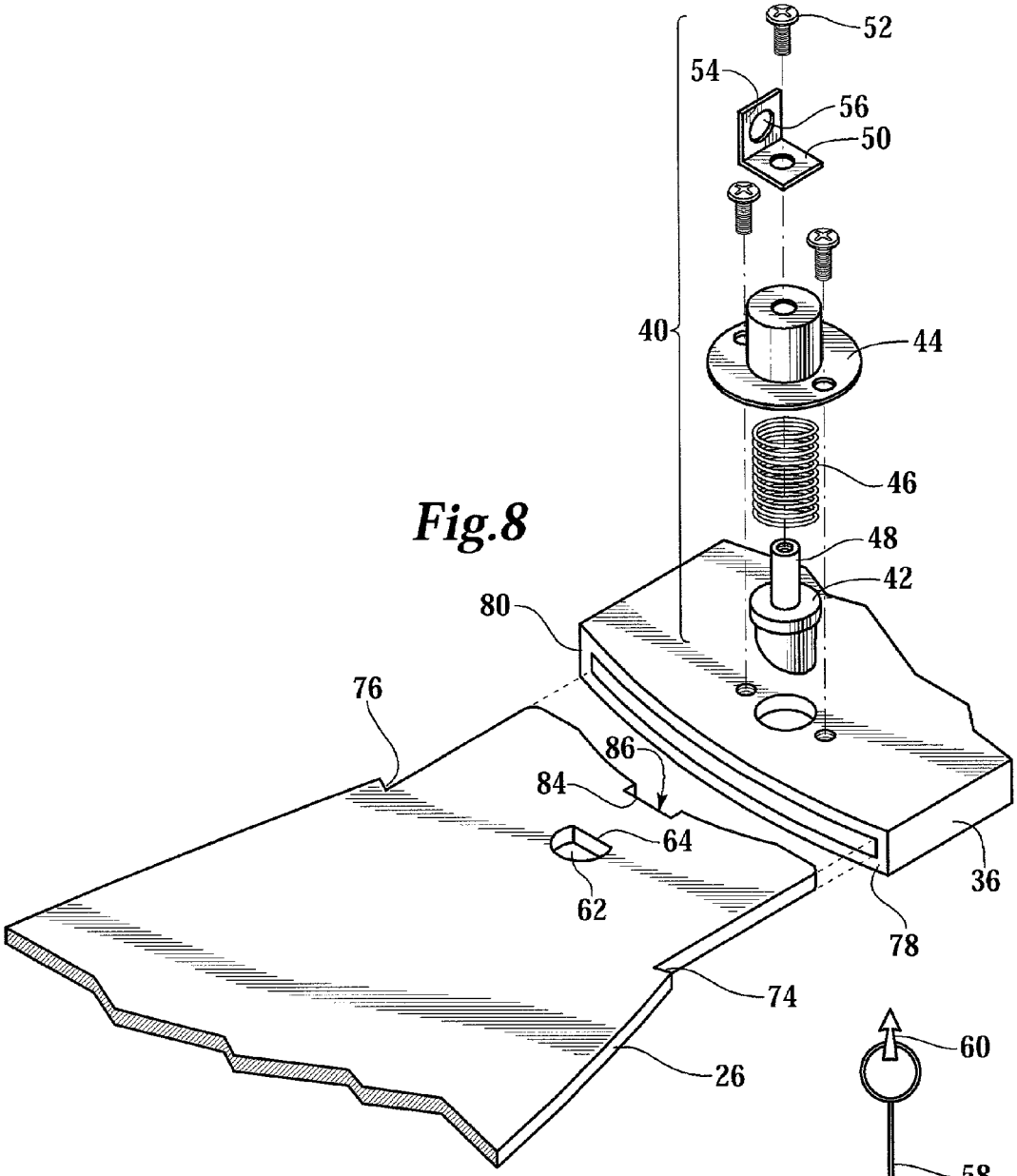
FIG. 8 depicts a partial perspective view of a fan blade aligned with a sleeve and an exploded view of a releasable engagement mounted to the sleeve.
Figure 9:
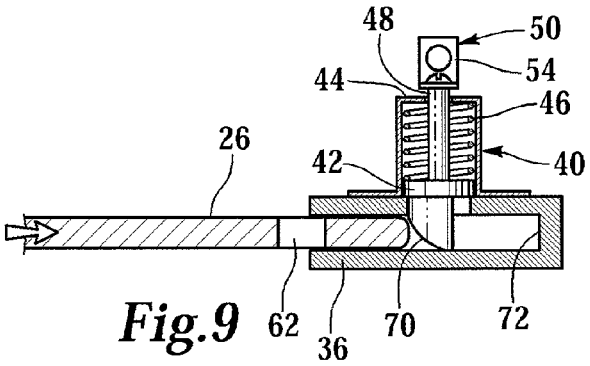
FIG. 9 depicts a section view of the fan components shown in FIG. 8, but with the fan blade being inserted into the sleeve.
Figure 10:
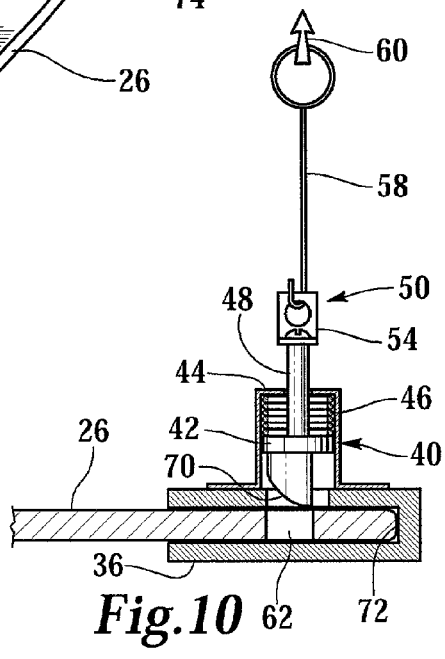
FIG. 10 depicts the fan components shown in FIG. 9, but with the fan blade fully inserted into the sleeve and with a pin being released by exerting a force on a tool to pull the pin.

The invention is further described with reference to the illustrated embodiment. The invention is not, however, limited to the described illustrated embodiment. FIGS. 1–4 depict a ceiling fan 10. FIGS. 5–7 are elevation views with part of the exterior removed to show part of the interior. FIGS. 8–10 show enlarged views of one embodiment of a releasable engagement. FIG. 1 is a plan view of the ceiling fan 10, i.e., looking down from above. FIG. 2 depicts a side elevation view of the ceiling fan 10. FIG. 3 depicts a bottom view of the fan 10. FIG. 4 is an elevation view of the ceiling fan 10 looking in a direction opposite that of FIG. 2.

The ceiling fan 10 is connected to a down rod assembly 12 that is suspended from the ceiling. The ceiling fan 10 comprises a motor 14 having a motor shaft 16 in a motor body 18. The motor body 18 rotates relative to the motor shaft 16. A housing 20 is stationary and is typically connected to the motor shaft 16 or the down rod 12. A motor housing 22 is connected to the motor body 18 and rotates with the motor body 18. Blade mounting arms 24 are connected to the motor body 18 and rotate with it. The blade mounting arms 24 may be positioned in the motor housing 22. An alternative position for the blade mounting arms 24 may be below the motor housing 22. Fan blades 26, 28 and 30 are preferably connected to the blade mounting arms 24 to rotate with the motor body 18. The fan blades may additionally or alternatively be secured to the motor housing 22 that rotates with the motor body 18.

For simplicity, connection of the fan blades will be described for one blade only. FIG. 2 depicts a slot 32 in the motor housing 22. In FIG. 3, fan blade 26 is shown separated from the motor housing 22 but aligned with the slot 32. A hub 34, which is typically attached to the motor shaft 16, is most visible in FIG. 3. The fan blade 26 may be connected directly to the motor body 18, connected via the blade mounting arm 24 or connected with a sleeve 36. Sleeve 36 may for example, be connected to the blade mounting arm 24. The blade 26 may also, or alternatively be secured to the motor housing 22, which then indirectly connects the blade 26 to the motor body 18.

For some applications, the fan blade 26 may be connected to the sleeve 36 with a releasable engagement 40. FIG. 8 shows a partial perspective view of the fan blade 26 aligned with the sleeve 36. An exploded view of an embodiment of the releasable engagement 40 is also shown.

In the embodiment depicted in FIGS. 8–10, the releasable engagement 40 is mounted on the sleeve 36. A pin 42 interacts with the fan blade 26 to secure the fan blade 26 in the sleeve 36. Pin 42 is mounted to the sleeve 36 with pin guide 44 wherein the pin biased downward with spring 46. It will be understood by those of skill in the art that use of directional terms such as up, down, above and below are relative terms used for convenience and illustration and are not intended to limit the scope of the teachings, except where explicitly indicated. The pin 42 comprises an internally threaded shaft 48 passing through the coil spring 46 and protruding through the pin guide 44. A catch 50 is secured to the pin shaft 48 with screw 52. The catch 50 illustrated an L bracket comprising a side wall 54 defining an opening 56; other designs will be apparent to those of skill in the art for catching the catch 50 with a tool 58.

In the embodiment shown in FIGS. 9–10, the releasable engagement 40 is biased downward; a force 60 is being applied to the releasable engagement 40 with the tool 58 to release the releasable engagement 40. In the specific embodiment depicted, the user catches the catch 50 with the tool 58 and pulls on the pin 42 to disengage the releasable engagement 40 from the fan blade 26.

In alternative embodiments the releasable engagement is released by applying a pushing force. It will also be apparent to those skilled in the art that the releasable engagement 40 need not be mounted on the sleeve 36 and may alternatively be mounted on, or internal to, the fan blade 26. In one such embodiment, the tool 58 would be used to apply a pushing force, rather than a pulling force, to release the releasable engagement 40. The force 60 applied may be at any convenient angle relative to the fan blade 26 that is appropriate for the particular embodiment of the releasable engagement 40 utilized.

The releasable engagement 40 is preferably biased to automatically engage an aperture 62 of the fan blade 26 when the fan blade 26 is properly positioned. In the particular embodiment illustrated in FIG. 10, the pin 42 interacts with the aperture 62 of the fan blade 26, thereby securing the fan blade 26 in the sleeve 36. In some embodiments, the aperture 62 comprises at least one flat edge 64 to further reduce wobbling, e.g., side-to-side motion of the fan blade 26.

In some applications the housing 20 comprises one or more access vents 68 to allow the tool 58 to contact the releasable engagement 40. With reference to FIG. 1, six access vents 68 are illustrated. FIGS. 5–7 show a side view of one access vent 68. In the illustrated embodiment, the access vent 68 is radially aligned with the catch 50. The fan blade 26 is rotated to angularly align the catch 50 with the access vent 68. The access vent 68 also allows heat to escape from the interior of the fan 10. The illustrated embodiment depicts, in FIG. 1, heat vents 69 to further allow heat to escape.

To facilitate engagement between the fan blade 26 and the motor body 18, the releasable engagement 40 comprises a slide 70 that automatically opens the releasable engagement 40 as the fan blade 26 is being inserted into the sleeve 36. In the embodiment depicted in FIGS. 9 and 10 the slide 70 is angled to slide over the fan blade 26 while the fan blade 26 is being inserted into the sleeve 36. As the fan blade 26 interacts with the slide 70, the pin 42 is lifted to allow the blade 26 to pass beneath the pin 42. When the fan blade 26 is properly positioned in the sleeve 36, the spring 46 will force the pin 42 to engage the aperture 62 of the fan blade 26, thereby securing the fan blade 26 in the sleeve 36. Alternatively, or in combination with the slide 70 of the releasable engagement 40, the fan blade 26 comprises a notch 84 that aligns with pin 42 when the fan blade 26 is properly aligned. A fan slide 86 positioned in the notch 84 is angled to facilitate lifting pin 42 so the fan blade 26 slides under the pin 42 as the fan blade 26 is pushed into position.

To facilitate positioning the fan blade 26 in the sleeve 36, the sleeve 36 has an inner wall 72 to indicate when the fan blade 26 is inserted far enough into the sleeve 36. It will be understood that the inner wall 72 need not enclose the fan blade 26, i.e., be a wall across an entire side of the sleeve 36. Preferably the fan blade 26 comprises edges 74 and 76 for interacting with edges 78 and 80 of the sleeve 36 to further facilitate proper positioning of the fan blade 26 in the sleeve 36.

A sleeve 36 need not surround the fan blade 26, but preferably the sleeve 36 has members, e.g., sides, webs, slates, sufficient to facilitate positioning of the fan blade 26 and reduce wobble of the fan blade 26 when the motor body 18 is rotated. Furthermore, for some embodiments a sleeve is not required at all. For example, the releasable engagement 40 may be positioned in the motor housing 22 to automatically engage the fan blade 26 when the fan blade 26 is properly positioned in the slot 32. The edges 74 and 76 may then interact with the slot 32 and the motor housing 22 to reduce wobble position the fan blade 26. Collectively, or independently, the sleeve 36 and the slot 32 act as an opening for receiving the fan blade 26 and supporting and stabilizing the fan blade 26.

Typically, the fan 10 will be sold as a kit wherein the releasable engagement 40 substantially eases assembly by the user. Due to the simplicity of removing and installing fan blades for the use of the releasable engagement, it is envisioned that fan blades 26–30 and any hub portion 82 may be sold separately. The hub portion 82 may, for example, comprise one or more of the following components: fan 14, motor shaft 16, motor body 18, blade mounting arm 24, sleeve 36, housing 20, motor housing 22 and releasable engagement 40. As discussed above, the fan blade 26 may comprise the releasable engagement 40 for interacting with the hub portion 82, thereby securing the fan blades 26 to the hub portion 82. A user may thereby customize the fan 10, or later change the fan 10 decor, to match decor of a room.

While the present invention has been described with reference to one or more particular embodiments, those skilled in the art will recognize that many changes may be made thereto without departing from the spirit and scope of the present invention. Each of these embodiments, and obvious variations thereof, is contemplated as falling within the spirit and scope of the claimed invention, which is set forth in the following claims.

What is claimed is:

1. A ceiling fan suspended by a down rod assembly, the fan comprising:

a motor having a motor shaft connected to the down rod assembly and a motor body which rotates relative to the motor shaft;

a blade mounting arm connected to the motor body and comprising a sleeve;

a fan blade positioned in the sleeve; and a releasable engagement securing the blade in the sleeve, wherein the releasable engagement is biased to extend into the sleeve solely perpendicularly to the fan blade.

2. The fan of claim 1, wherein the sleeve comprises an inner wall facilitating proper positioning of the blade in the sleeve.

3. The fan of claim 1, wherein the releasable engagement is mounted on the sleeve and the fan blade comprises an aperture interacting with the releasable engagement when the fan blade is properly positioned.

4. The fan of claim 1, wherein the fan blade comprises an aperture and the releasable engagement is biased to automatically engage the aperture of the fan blade when the fan blade is properly positioned, whereby the fan blade is secured in the sleeve.

5. The fan of claim 1, wherein the releasable engagement comprises a pin extending into the sleeve and through the fan blade for securing the fan blade in the sleeve.

6. The fan of claim 5, wherein the pin is biased to automatically secure the fan blade in the sleeve when the fan blade is properly positioned in the sleeve.

7. The fan of claim 6, wherein the pin comprises a slide sliding over the blade while the blade is being inserted in the sleeve, wherein the slide is angled to lift the pin to allow the blade to pass beneath the pin.

8. The fan of claim 6, wherein the pin comprises a catch for interacting with a tool for releasing the releasable engagement by applying a force to the tool.

9. The fan of claim 8, wherein the releasable engagement is released when the pin is pulled away from the fan blade.

10. The fan of claim 1, wherein the releasable engagement comprises a slide for automatically opening the releasable engagement while the fan blade is being inserted into the sleeve.

11. The fan of claim 1, comprising a housing covering the motor shaft, wherein the housing has an access vent above the releasable engagement through which a tool may contact the releasable engagement.

12. A fan comprising:

a motor having a motor shaft and a motor body that rotates relative to the motor shaft;

a motor housing rotatable with and connected to the motor body, wherein the motor housing comprises a blade mounting arm having a slot;

a fan blade inserted into the slot; and a releasable engagement positioned in the motor housing and comprising a solely perpedicular movable pin to automatically engage the fan blade when the fan blade is properly positioned in the slot, whereby the fan blade is secured.

13. The fan of claim 12, wherein the pin is spring biased to engage the fan blade and the fan blade comprises an aperture for receiving the pin, whereby the fan blade is secured in the slot when the pin engages the aperture.

14. The fan of claim 13, wherein the pin comprises a slide for sliding over the fan blade while the fan blade is being positioned in the slot and the slide is angled to lift the pin out of the way of the fan blade.

15. The fan of claim 12, wherein the releasable engagement comprises a catch for interacting with a tool for releasing the releasable engagement by applying a force to the tool.

16. The fan of claim 12, comprising a stationary housing connected to the motor shaft.

17. The fan of claim 16, wherein the stationary housing comprises an access vent providing access to the releasable engagement.

18. The fan of claim 17, wherein the stationary housing comprises heat vents to release heat.

19. A method of removing a fan blade connected to a motor body with a releasable engagement, the method comprising:

locating the releasable engagement securing the fan blade in position, wherein the releasable engagement traverses the fan blade;

applying a force to release the releasable engagement wherein applying the force to release the releasable engagement comprises catching a catch of the releasable engagement with a tool and pulling the tool in a direction perpendicular to the fan blade; and withdrawing the fan blade from a sleeve.

20. The method of claim 19, comprising aligning an access vent positioned above the fan blade with the releasable engagement by rotating the fan blade.

21. A fan kit comprising:

a motor body;

three fan blade arms adapted to be connected to the motor body, each fan blade arm comprising fan blade engaging structure wherein the fan blade engaging structure comprises a sleeve; and three fan blades adapted to be secured to the three fan blade arms, each fan blade comprising fan blade arm engaging structure, wherein the fan blade engaging structure and the fan blade arm engaging structure are adapted to engage when the fan blade is properly positioned, wherein the fan blade engaging structure further comprises a member biased to extend into the fan blade arm engaging structure solely perpendicularly.

22. The kit of claim 21, comprising:

a tool for catching one of the fan blade arm engaging structure or the fan blade engaging structure, whereby applying a force to the tool can disengage the caught structure and release the fan blade.

23. A ceiling fan comprising:

a motor having a motor shaft and a motor body that rotates relative to the motor shaft;

a plurality of fan blades releasably secured to the motor body; and a plurality of means for releasably engaging the fan blades with the motor body, wherein the means comprises a pin biased to move solely perpendicularly to the fan blades and traverse the fan blades.

24. The ceiling fan of claim 23, comprising a plurality of fan arms connecting the fan blades to the motor body, wherein the fan blades releasably engage the fan arms.

25. The ceiling fan of claim 23, comprising means defining openings for receiving the fan blades.

26. A ceiling fan comprising:

a plurality of fan blades;

means for rotating the fan blades; and means for automatically securing the fan blades to the means for rotating the fan blades when the fan blades are properly positioned, wherein the means for automatically securing the fan blades comprises a pin biased to move perpendicular to and through the fan blade.

27. The ceiling fan of claim 26, wherein the means for automatically securing the fan blades comprises means for automatically opening the means for automatically securing the fan blades, including moving the pin, while the fan blades are being positioned.

28. A fan comprising:

a hub portion comprising a fan blade arm having a sleeve for receiving a fan blade;

a fan blade connected to the fan blade arm and positioned in the sleeve; and a releasable engagement automatically securing the fan blade to the fan blade arm, wherein the releasable engagement soleley perpendicularly traverses the fan blade.

29. The fan of claim 28, comprising a slide angled to open the releasable engagement as the fan blade is being positioned in the sleeve.

30. The fan of claim 29, wherein the releasable engagement is mounted on the sleeve and comprises a pin adapted to interact with the fan blade.

31. The fan of claim 30, wherein the fan blade comprises an aperture adapted to interact with the pin.

32. The fan of claim 31, wherein the aperture conforms to the pin.

33. The fan of claim 32, wherein both the aperture and the pin are non-circular.

34. The fan of claim 28, wherein the fan blade comprises an aperture and the releasable engagement comprises a pin adapted to move perpendicular to the fan blade and into the aperture of the fan blade.

35. The fan of claim 34, wherein the pin comprises a slide angled to interact with the fan blade to open the releasable engagement as the fan blade is being properly positioned.

36. The fan of claim 28, comprising a slide to open the releasable engagement as the fan blade is being inserted into position.

37. The fan of claim 36, wherein the releasable engagement comprises a spring biasing the releasable engagement to automatically close when the fan blade is properly positioned, whereby the fan blade is secured to the fan blade arm.

38. The fan of claim 28, wherein the hub portion comprises a housing covering the releasable engagement.

39. The fan of claim 38, wherein the housing comprises an access vent to access the releasable engagement from above the fan blade.

40. The fan of claim 38, wherein the hub portion comprises a motor body and wherein the housing comprises a stationary component and a rotatable component; and wherein the rotatable component of the housing is connected to the motor body.

* * * * *

UNITED STATES PATENT AND TRADEMARK OFFICE

CERTIFICATE OF CORRECTION

PATENT NO. : 7,008,192 B2
APPLICATION NO. : 10/154125
DATED : March 7, 2006
INVENTOR(S) : Rolando Hidalgo It is certified that error appears in the above-identified patent and that said Letters Patent is hereby corrected as shown below:

| | |
|---|---|
| Cl. 12, col. 6, line 47 | Replace “perpedicular” with --perpendicular-- |
| Cl. 28, col. 8, line 16 | Replace “soleley” with --solely-- |

Signed and Sealed this

Third Day of October, 2006

JON W. DUDAS
*Director of the United States Patent and Trademark Office*